US005626047A

United States Patent [19]

Bello

[11] Patent Number: 5,626,047

[45] Date of Patent: May 6, 1997

[54] FIXED DUMMY BLOCK ASSEMBLY

[76] Inventor: Luis B. Bello, 2180 NW. 82nd Ter., Pembroke Pines, Fla. 33024

[21] Appl. No.: 556,390

[22] Filed: Nov. 13, 1995

[51] Int. Cl.[6] ..... B21C 25/00

[52] U.S. Cl. ..... 72/273

[58] Field of Search ..... 72/273, 273.5, 72/253.1, 478, 264, 265, 272, 255

[56] References Cited

U.S. PATENT DOCUMENTS

| | | | |
|---|---|---|---|
| 3,630,064 | 12/1971 | Mahns | 72/273 |
| 3,919,873 | 11/1975 | Biswas et al. | 72/273 |
| 4,286,453 | 9/1981 | Exner | 72/273 |
| 4,550,584 | 11/1985 | Degen | 72/273 |
| 5,272,900 | 12/1993 | Robbins | 72/273 |
| 5,311,761 | 5/1994 | Robbins | 72/273 |

FOREIGN PATENT DOCUMENTS

| | | | |
|---|---|---|---|
| 3711752 | 10/1988 | Germany | 72/273 |
| 0264216 | 11/1988 | Japan | 72/273 |

*Primary Examiner*—Lowell A. Larson
*Assistant Examiner*—Ed Tolan
*Attorney, Agent, or Firm*—Malloy & Malloy, P.A.

[57] ABSTRACT

An improved fixed dummy block assembly to be used with a heavy duty metal extrusion assembly including a hydraulic press and a billet container. The assembly includes a stem connected with the press in axial alignment with the billet container so as to be pushed by the press towards an open inlet end of the billet container. Further, the stem, which is generally elongate and includes a first end having an axial socket extending into the stem therethrough, is structured to receive an exterior dummy block member therein within the axial socket. The exterior dummy block member includes an expansion segment and a connector segment, the connector segment being structured to be axially and slidingly inserted into the axial socket of the stem so as to be securely, yet removably locked in place without the use of any threads. The expansion segment of the exterior dummy block member includes an open interior area having a bell head containment portion and a bell stem containment portion into which a compression bell is inserted and secured. The bell itself has a bell head which fits in the bell head containment portion and bell connector stem which extends into the bell stem containment portion and is secured therein in a threadless manner such that the bell head is retained in the bell head containment portion and will protrude slightly from a front end of the expansion segment in order to engage the metal billet first and engage the expansion segment in order to outwardly flex of the surrounding wall structure of the expansion segment.

12 Claims, 2 Drawing Sheets

FIXED DUMMY BLOCK ASSEMBLY

BACKGROUND OF THE INVENTION

1. Field of the Invention

The present invention relates to an improved fixed dummy block assembly to be used with a heavy duty metal extrusion assembly so as to replace a standard dummy block with an assembly that is quick and easy to install and secure in place, as well as to remove and replace when necessary, and which significantly minimizes operation down-time generally associated with the preheating and parts replacement requirements of known dummy block assemblies, in a durable effective and adaptable assembly.

2. Description of the Related Art

A variety of large metal parts that are utilized throughout industry are made by heavy duty extrusion procedures. Simply put, the extrusion procedures utilize a quantity of heated, and therefore deformable, metal, in a large block generally called a billet. This metal billet is introduced into an extrusion assembly which pushes the billet through a specific die that defines the desired output shape. Often, however, because of the natural properties of the metal being utilized for extrusion, it is difficult to maintain a balanced billet consistency, which is neither too soft nor too hard, and is therefore appropriate for effective extrusion. Specifically, it is evident, that in order to enable the billet to be extrudeable in a typical extrusion procedure, it is necessary to maintain substantially high temperatures during operation so that the metal billet is softened and can be pushed through the die. Still, however, the operating temperatures must not be so high so as to make the metal billet soften to the point where it looses all its rigidity and is therefore unmoldable as it will not retain its extruded form when pushed through the die. As such, an ideal billet consistency will require that a substantial amount of force is exerted on the billet in order to push it through the relatively small openings of the die. Accordingly, a major cause for downtime and/or operational malfunctions during extrusion procedures relates to the substantial amounts of stress exerted on the extrusion equipment, and the substantially high operating temperatures which can weaken the structure of the extrusion equipment, thereby leading to breakage.

Conventional heavy duty metal extrusion assemblies generally include a hydraulic press and a billet container. In particular, the billet container includes a die end over which the extrusion die is positioned and from which the formed part exits. Accordingly, an interior wall surface of the billet container is structured to contain the metal billet as it is pushed towards the die in order to form the extruded part. Generally, the metal billet is pushed into the billet container, and towards the extrusion die, by an elongate stem connected to the hydraulic press. Disposed on an end of the stem is a dummy block which is structured to substantially ensure that metal from the metal billet only exits the billet container through the die. Further, conventional dummy blocks are generally sized to be substantially equivalent to an interior dimension of the billet container, thereby protecting, to the greatest extent possible, the stem and other operating parts of the extrusion press from being covered and possibly damaged by metal from the metal billet, and maximizing the overall percentage of the metal billet that is actually pushed through the extrusion die to form the finished part. Still, however, because some clearance must be provided if the dummy block is to slide into the billet container, and because of the heavy compression forces utilized during the extrusion process, some seepage of metal usually results over the surface of a conventional dummy block. While this seepage may not be sufficient to contaminate the stem or other portions of the extrusion assembly, the dummy block itself tends to become contaminated or otherwise coated to the point where it is inoperable and necessitates frequent replacement after a small number of uses. Furthermore, standard dummy blocks are generally aligned at a pin on the end of the stem. Subsequent to extrusion, however, such a pin interconnection is insufficient to pull back the dummy block and fully separate it from the remaining billet. As a result, a layer of metal often becomes stuck on the dummy block, requiring manual removal, often by chipping away with a hammer and/or chisel. Of course, such manual removal requires the cycling of multiple dummy blocks to avoid excess down time, and can easily lead to damage to the surface of the conventional dummy block. Accordingly, and because of the great expense and time delay associated with continuous standard dummy block replacement and/or cycling, others in the art have sought to implement alternative dummy block assemblies. These alternative dummy block assemblies are conventionally known as fixed dummy block assemblies. Specifically, fixed dummy block assemblies are structured to permit continuous or at least repeated use, and generally include a bell portion that is movably retained within the dummy block housing. In use, the bell portion of the fixed dummy block engages the metal billet first and is pushed back into the dummy block housing. Due to the great compressive force which is exerted on the billet by the bell and the resistive force provided by the billet as it resists compression and extrusion, the bell portion will engage the walls of the dummy block housing resulting in a flexing of the surrounding wall until the housing's exterior expands to within very small clearance of the interior surface of the billet container. Accordingly, as the fixed dummy block is inserted into the billet container, the perimeter diameter of the dummy block housing is slightly smaller than the interior surface of the billet container; however, when contact with the metal billet is made and the dummy block housing flexes outwardly, the perimeter diameter of the dummy block housing will be substantially equivalent to the interior surface diameter of the billet container such that very little space will remain between the housing and the sidewalls of the billet container to prevent significant outward seepage of the metal billet over the surface of the dummy block housing and therefore the stem. Conversely, when the fixed dummy block is removed from the billet container, the diameter of the fixed dummy block housing returns to its normal diameter and facilitated removal is achieved. This seepage prevention, which maximizes the amount of the metal billet that is used and protects the operating equipment, is therefore one primary reason why the use of a fixed dummy block assembly is substantially beneficial and cost saving for industries using heavy duty metal extrusion systems. Furthermore, the secure engagement between the fixed dummy block and the stem permits separation of the dummy block from the billet without the need to cut or scrape the remaining billet metal.

Still, however, there are a number of problems associated with fixed dummy block assemblies. One such problem involves the overall size of conventional fixed dummy blocks, and hence the manner in which the fixed dummy block portion of the assembly must be secured to an end of the stem. Conventionally, most fixed dummy blocks are necessarily quite long and heavy, as compared with standard dummy blocks, due to the intricate interior configurations necessitated by prior art dummy block assemblies. In particular, most prior fixed dummy blocks incorporate interior threaded and/or biased interconnections which call for added interior spacing for both operational and repair purposes. As such, prior art assemblies require a portion of the conventional sized stem to be cut off to a length which matches the precise length required by the fixed dummy block assembly to ensure maximum extrusion. Not only does this require extensive and possibly damaging cutting of the stem, but more importantly, such shortening of the stem makes the modified stem, and hence the extrusion assembly, substantially unusable unless an entire, matching, replacement fixed dummy block assembly is available.

Further, most conventional dummy block assemblies provide for securing of the fixed dummy block portion via a threaded connection. Such a design can be seen in U.S. Pat. No. 5,311,761 to Robbins. This design, as with many conventional fixed dummy block designs, includes a stud portion that is threaded into the cut off stem. If, however, the device breaks or becomes coated with excess metal and must therefore be replaced, the substantially high temperatures and the problems associated with the removal of partially broken threads make it quite difficult to remove the stud, and hence the fixed dummy block portion from the stem. For this reason, a device such as that in U.S. Pat. No. 5,272,900, also to Robbins, is provided to include a bayonet type connection between the stud and the stem. Unfortunately, however, while this improvement does generally facilitate removal of the fixed dummy block from the stem, it does not address a number of additional problems associated with fixed dummy block use.

In particular, after extensive experimentation it has been determined that the incorporation of a number of threaded elements and various separate components within the fixed dummy block itself can lead to significant disadvantages during use of the fixed dummy block assembly. Specifically, it is often the bell portion of the fixed dummy block which becomes contaminated or otherwise damaged while the remainder of the fixed dummy block assembly remains fully operational. As a result, efficiency considerations dictate that in certain circumstances the bell portion alone be removed and replaced, thereby saving the expense associated with the replacement of an entire fixed dummy block and minimizing the downtime required for obtaining and replacing the entire dummy block. Because of the expense of the overall dummy block portion of the assembly, many facilities only keep one fixed dummy block portion on hand. Unfortunately, even if the operators wish to replace only the bell portion, most fixed dummy block assemblies, even those which include a bayonet type stem connection as in U.S. Pat. No. 5,272,900, include a bell portion that is threadedly secured in place within the housing of the fixed dummy block by way of a bolt or like fastener element. Additionally, the bell portion may be connected to a variety of springs and the like within the housing of the fixed dummy block. As a result, under the substantially high temperatures associated with fixed dummy block use, it can be significantly difficult to remove the bell portion from its secured position within the fixed dummy block, especially if the bell, and/or some of its threaded connections are partially broken. Also, the conventional configuration and interconnection of the bell portion and the housing will generally necessitate that the access to the bell portion must be achieved from an interior of the fixed dummy block housing because only minimal portions of the bell are exposed from the housing and a substantial grip of the bell is necessary if it is to be effectively unscrewed. There is, therefore, a need for an improved fixed dummy block assembly which provides for convenient and facilitated removal of merely the bell portion of the fixed dummy block as well as facilitated removal of the entire fixed dummy block from the stem in a quick and effective manner. Furthermore, because the stud is screwed into the housing portion, even with a bayonet type stud-stem connection, appropriate disengagement of the stud from the stem cannot be achieved if the threaded stud-housing connection is broken and the stud cannot be rotated effectively by turning the stem. In this regard the removable stud must be employed to permit access to the bell-housing connection within the housing.

Further, during replacement of fixed dummy blocks, a major source of added cost and/or downtime generally relates to the requirement that the fixed dummy block be heated when mounted on the stem. The pre-heating is primarily done to minimize the risks of breakage or fracture of the fixed dummy block portion when introduced into the hot, high pressure operating environment. In particular, the preheating is especially directed towards heating the numerous threaded portions that are contained within the fixed dummy block assembly. Specifically, the commonly employed threaded interconnections between the entire fixed dummy block portion and the stem, between a stud and the fixed dummy block housing, and/or between the bell portion and the housing of the fixed dummy block are much more susceptible to shatter and breakage if exposed to substantial quantities of stress without being preheated. Unfortunately, however, because of the ridged, mating interconnection of the threaded portions, often within an interior of the fixed dummy block housing, the threaded connections are very difficult to fully heat and thereby necessitate direct preheating of the entire fixed dummy block portion in a special oven or heating unit. Also, if the threaded portion is the portion of the fixed dummy block assembly that shatters, it substantially increases the difficulty associated with removal and/or separation of portions of the fixed dummy block. Furthermore, because conventional fixed dummy blocks must be generally large and elongate due to their intricate interior mechanism, direct heating on the stem would take a substantial amount of time, a consequence that further leads to costly down time.

In addition to ensuring that the threaded portions within the fixed dummy block assembly are sufficiently preheated, another problem associated with conventional fixed dummy block assemblies involves ensuring that the threaded portions within the fixed dummy block are not overly hot. Specifically, the threaded portions of the fixed dummy block assembly are most susceptible to breakage because under the high temperatures and high stress, they are subject to some play or stretching during the constant load cycles endured by the fixed dummy block. Not only does this stretching of the threads lead to quicker breakage, but also the play between the threads increases as the gaps stretch even further such that the fixed dummy block assembly does not remain properly aligned as it is introduced into the billet container for compression of the billet. This improper alignment can lead to malfunctions in the extrusion cycle and can lead to excessive damage or wear to the billet container. It is therefore evident that there is a substantial need in the art to provide an improved fixed dummy block assembly which identifies the previously unaddressed and unidentified problems associated with the use of threaded portions within a fixed dummy block assembly by eliminating all threaded portions of interconnection within a simple and effective device. Additionally, there is a need in the art for an effective fixed dummy block assembly which is efficiently configured to be substantially compact thereby eliminating the need to cut the conventional stem of an extrusion press and allowing for rapid and effective heating of the fixed dummy block directly on the stem. Further, there is a need in the art for a fixed dummy block assembly which is capable of operating at the high temperatures associated with metal extrusion, but which is also capable of balancing temperatures therein to ensure that the fixed dummy block assembly itself does not get too hot so as to be subjected to excessive wear or potential deformation.

SUMMARY OF THE INVENTION

The present invention is directed towards an improved fixed dummy block assembly to be used with a heavy duty metal extrusion assembly. The metal extrusion assembly is generally of the type including a hydraulic press and a billet container. The billet container includes a die end over which an extrusion die is positioned and from which a formed part exits, an interior wall surface which contains a metal billet that provides the raw material from which the formed part is extruded, and an open inlet end opposite the die end into which the improved fixed dummy block assembly will enter the billet container for compression of the metal billet.

In particular, the fixed dummy block assembly includes a stem which is connected with the hydraulic press. The stem is disposed in axial alignment with a central axis of the billet container and is structured to be pushed towards the open inlet end of the billet container by the hydraulic press.

The stem, which is generally elongate, includes a first end disposed in confronting relation with the open inlet end of the billet container. This first end of the stem has an axial socket extending therethrough into the stem. In particular, the axial socket includes an outer end at the first end of the stem and an inner end within an interior of the stem.

Also included in the fixed dummy block assembly of the present invention is an exterior dummy block member. The exterior dummy block member is divided primarily into an expansion segment and a connector segment. The connector segment is specifically structured and disposed to be axially and slidingly inserted into the axial socket of the stem. Further, the axial socket and the connector segment include threadless locking means structured and disposed to secure the exterior dummy block member in axial alignment at the first end of the stem so as to prevent accidental removal of the connector segment from the axial socket.

With regard to the expansion segment of the exterior dummy block member, it includes a front end, a rear end, and a surrounding wall structure that defines an open interior area. The open interior area extends inwardly from the front end of the expansion segment and is divided into a bell head containment portion and a bell stem containment portion.

As such, the fixed dummy block assembly of the present invention also includes a compression bell. The compression bell includes a bell head, which has a primary face, a rear face, and a surrounding wall structure, and a bell connector stem extending from the rear face of the bell head in a direction opposite the primary face of the bell head. In use, the compression bell is structured and disposed to be contained within the open interior area of the expansion segment such that the bell stem extends into the bell stem containment portion of the open interior area of the expansion segment and such that the bell head is retained in the bell head containment portion of the open interior area of the expansion segment. Preferably, the compression bell will protrude slightly from the front end of the expansion segment, but will engage the expansion segment in such a manner that upon the primary face of the bell head contacting the metal billet within the billet container, the compression bell is pushed into the open interior area of the expansion segment to result in an outward flexing of the surrounding wall structure of the expansion segment. Accordingly, a perimeter dimension of the expansion segment is able to vary slightly during compression of the metal billet in the extrusion cycle.

Finally, the bell stem and bell stem containment portion both include threadless bell locking means structured and disposed to maintain the bell stem securely, yet removably within the bell stem containment portion, and thereby maintain the compression bell securely within the open interior area of the expansion segment.

It is an object of the present invention is to provide an improved fixed dummy block assembly which contains no interior or exterior threaded interconnections between the bell portion, the housing of the fixed dummy block, and the stem, thereby significantly minimizing the assembly's susceptibility to breakage and substantially facilitating the removal and/or disconnection of one or more parts of the fixed dummy block from one another or from the stem.

Also an object of the present invention is to provide an improved fixed dummy block assembly which does not need to be preheated but is structured to be effectively heated directly on the stem.

Another object of the present invention is to provide an improved fixed dummy block assembly with a substantially small number of component parts, thereby minimizing the cost and minimizing the susceptibility to breakage of the assembly.

A further object of the present invention is to provide an improved fixed dummy block assembly which is structured to eliminate the requirement that the conventional stem associated with an extrusion press be cut and shortened to accommodate the fixed dummy block portion of the overall assembly, thereby minimizing the added stress placed on the shortened stem and enabling the fixed dummy block to be of a sufficiently small dimension to be heated directly on the stem.

Also an object of the present invention is to provide an improved fixed dummy block assembly which does not require any modification of a conventional stem length and is adaptable to receive a conventional dummy block if the fixed dummy block portion of the assembly must be temporarily removed for repair or replacement and a replacement fixed dummy block portion is not immediately available, thereby substantially minimizing the downtime associated with the repair or replacement of the fixed dummy block portion of the assembly.

An additional object of the present invention is to provide an improved fixed dummy block assembly which can be liquid cooled during operation, thereby ensuring that the assembly does not get too hot during use.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 9:
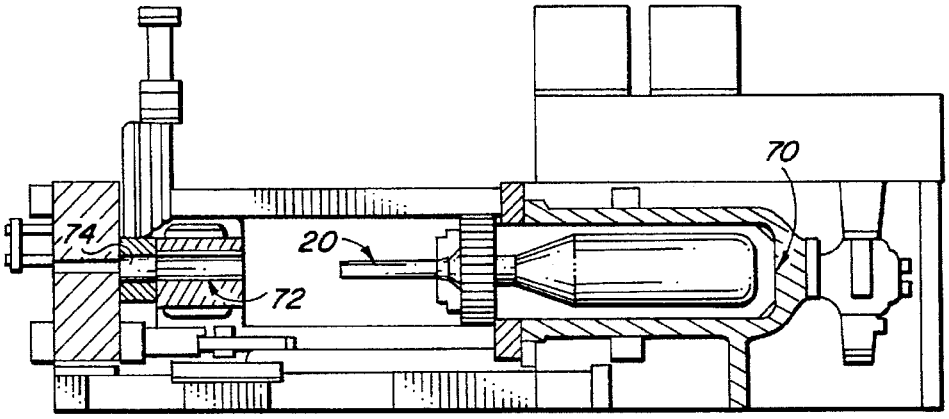
FIG. 9 is a side plan view of a conventional heavy duty metal extrusion assembly.

Shown throughout the Figures, the present invention is directed towards an improved fixed dummy block assembly. The fixed dummy block assembly is structured primarily for use with a heavy duty metal extrusion assembly, such as that illustrated schematically in FIG. 9. Conventionally, the heavy duty metal extrusion assembly includes a hydraulic press 70 that is structured to push a metal billet, with a substantially high degree of force and under very high temperatures. Additionally, the extrusion assembly will include a billet container. The billet container is generally a round container type portion of the extrusion assembly that has a die end, an open inlet, and a preferably smooth interior wall surface. During use, a metal billet or block of partially softened metal is introduced into the billet container. The die end of the billet container has an extrusion die 74 positioned thereover. The extrusion die is configured to provide an outlet therethrough in the exact shape of the part to be extruded. As such, an elongate metal beam having a particular configuration or contour can be formed utilizing the die end. Conversely, the open inlet end is completely opened and is where the improved fixed dummy block assembly is introduced in order to push the metal billet towards the extrusion die until substantially all of the metal billet has passed through the extrusion die in order to form the formed part.

Turning specifically to the improved fixed dummy block assembly of the present invention, it includes a stem 20, which is connected with the hydraulic press 70. The stem 20 is preferably a strong, rigid elongate cylinder that is axially aligned with a central axis of the billet container and is thereby pushed by the hydraulic press 70 axially into the billet container. In conventional hydraulic press systems the stem is structured of a sufficient length such that a generally short standard dummy block engages an end thereof and provides for maximum extrusion, with the dummy block being substantially close to the extrusion die within the billet container, upon the hydraulic press reaching its full pushing distance. Unlike stems associated with prior art fixed dummy block assemblies, the stem of the present invention retains that standard length such that if a standard dummy block is secured to an end thereof is will operate as a conventional stem would. In particular, the stem 20 of the present invention is generally elongate and includes a first end 22 disposed in generally confronting relation with the open inlet end of the billet container 72. Opposite the first end 22 of the stem 20 is a second end 21 which is structured to be secured to the hydraulic press 70, preferably in a somewhat permanent, but at the very least a substantially secured manner.

Disposed within the stem 20 and extending therein through the first end 22 of the stem 20 is an axial socket 24. The axial socket 24 includes an outer end 24' at the first end 22 of the stem 20, and an inner end 24" within an interior of the stem 20. The axial socket 24 will be discussed in greater detail subsequently.

Further included in the improved dummy block assembly of the present invention, as part of a fixed dummy block portion generally indicated as 30, is an exterior dummy block member 22. The exterior dummy block member 22 includes primarily an expansion segment 24 and a connector segment 40 which are preferably integrally formed with one another. The connector segment 40 is structured and disposed to be axially and slidingly inserted into the axial socket 24 of the stem 20, thereby securing the fixed dummy block portion 30 of the improved fixed dummy block assembly to the first end 22 of the stem 20.

The axial socket 24 and the connector segment 40 include threadless locking means. Specifically, the threadless locking means are structured and disposed to secure the exterior dummy block member 22 in axial alignment at the first end 22 of the stem 20 so as to prevent accidental removal of the connector segment 40 from the axial socket 24. Significantly, the threadless locking means maintain secured interconnection without the use of any threaded portions that can be susceptible to breakage, can hinder removal or other disengagement, and can lead to some play between the stem 20 and fixed dummy block portion 30.

In the preferred embodiment, the threadless locking means on the axial socket 24 include preferably four, but at least one entry channel 25 extending along an interior of the axial socket 24. The entry channel is structured to extend from the outer end 24' to generally the inner end 24" of the axial socket 24. Further, the threaded locking means in the axial socket 24 include, preferably four, but at least one lock recess 26 formed in the interior of the axial socket 24, generally at the inner end 24" of the axial socket 24, and in adjacent communication with the entry channel.

The threaded locking means on the axial socket are structured for mating engagement with the threaded locking means on the connector segment 40. Those threaded locking means include preferably four, but at least one lock segment 42 protruding from a perimeter of the connector segment 40. In particular, the lock segment 42 can include a single lock segment, a pair of opposed lock segments, or any number of additional lock segments such as three or four, which in the preferred embodiment for secure retention illustrated in the figures, so long as the axial socket 24 includes a corresponding number of entry channels 25 and lock recesses 26 formed therein. Accordingly, in order to secure the connector segment 40 within the axial socket 24, the lock segments 42 of the connector segment 40 are aligned with the entry channels 25 permitting the connector segment 40 to slide into the axial socket 24. When the connector segment 40 is substantially within the axial socket 24 such that the lock segments 42 are aligned with the lock recesses 26, the connector segment 40 is structured to be rotated until the lock segments 42 are disposed in an engaged orientation within the lock recess 26. In the engaged orientation, the connector segment 40 can no longer be axially pulled out the entry channels 25, unless affirmatively rotated out of the engaged orientation to provide the desired removal. It therefore seen, that during operation if a malfunction of a fixed dummy block portion 30 arises wherein the fixed dummy portion 30 must be replaced, a worker must merely rotate the fixed dummy block portion 30 such that the connector segment 40 rotates and the lock segments 42 are aligned with the entry channels 25 to permit facilitated removal.

Additionally, so as to prevent accidental rotation of the connector segment 40 relative to the axial socket 24, the threadless locking means preferably include a lock slot 28 extending from an exterior of the stem 20 into the inner end 24" of the axial socket 24 in the stem 20. This lock slot 28 is structured to receive a lock pin, which can be any conventional type of elongate pin that is retained in place by any conventional means, such as through a small number of threads at the head of the lock pin since the lock pin will not be subjected to substantial stress along its axis and will therefore not be hindered or susceptible to brakeage as a result of the threads. Further, the connector segment 40 will preferably include a retention recess 44 formed therein, the retention recess is structured to be aligned with the lock slot 28 upon the connector segment 40 being disposed in the engaged position. Accordingly, the lock pin is able to extend through the lock slot 28 and into the retention recess 44 in order to prevent relative rotation between the connector segment 40 and the axial socket 24.

Turning to the expansion segment 24 of the exterior dummy block member 22, it includes a front end 25, a rear end 27 and a surrounding wall structure 28. The surrounding wall structure 28 specifically defines an open interior area which extends inwardly from the front end 25 of the expansion segment 24, and may preferably extend slightly into the connector segment 40. In particular, the open interior area is divided into a bell head containment portion 29 and a bell stem containment portion 30 to be discussed in greater detail hereafter.

Structured to be disposed within the open area within the expansion segment 24 is a compression bell 50. The compression bell 50 is preferably a single solid element which includes a bell head 52 and a bell connector stem 54. Specifically, the bell head 52 includes a primary face 53, a rear face 53' and a surrounding wall structure 53". As to the bell connector stem 54, it extends from the rear face 53' of the bell head 52 in a direction opposite the primary face 53 of the bell head 52. The bell connector stem 54 is structured and disposed to be inserted and contained within the open interior area of the expansion segment 24. In use, the compression bell 50 is contained within the open interior area of the expansion segment 24 such that the bell stem 54 extends into the bell stem containment portion of the open interior area of the expansion segment 24 while the bell head 52 is retained in the bell head containment portion 29 of the open interior area of the expansion segment 24.

Further, the bell stem and bell stem containment portions include threadless bell locking means which are structured and disposed to maintain the bell stem 54 securely, yet removably within the bell stem containment portion 30. Preferably, the threadless bell locking means in the bell stem containment portion 30 include four, but at least one or more entry channels 32 which extend axially along an interior of the bell stem containment portion 30. Further, the threadless bell locking means include preferably four, but at least one or more to match the number of entry channels, lock recesses 34. The lock recesses 34 are also formed in an interior of the bell stem containment portion 30 and are disposed in adjacent communication with the corresponding entry channels 32.

The threadless bell locking means on the bell stem 54 include preferably four, but at least one or more to correspond the number of entry channels 32, lock segments 54 that protrude from a perimeter of the bell stem 54. These lock segments 54 are structured and disposed to slidingly move through the entry channels 32 of the bell stem containment portion 30, upon axial insertion of the bell stem 54 into the bell stem containment portion 30. Once the bell stem 54 is fully inserted into the bell stem containment portion 30, the lock segments 55 are structured to slide from the entry channels 32 into the corresponding lock recesses 34 of the bell stem containment portion 30, upon axial rotation of the compression bell 50 within the expansion segment 24, thereby providing mating engagement of the lock segments 55 within the lock recesses 34. Therefore, accidental removal or dislodging of the compression bell 50 from the expansion segment 24 is substantially prevented unless the compression bell 50 is affirmatively rotated out of the engaged position. When removal is desired, it is substantially facilitated and the breakage of any portion of the bell does not substantially hinder its removal. Moreover, the front face 53 of the compression bell 50 may include a rotation recess 58 formed therein to facilitate rotation of the bell 50 relative to the expansion segment 24, such as through the insertion of a pin into the rotation recess to act as a handle for disengaging rotation of the bell 50.

Also, so as to provide additional security, the threadless bell locking means may also include a bell lock slot 36 extending from an exterior of the exterior dummy block member 22 and into the bell stem containment portion such that a stem lock pin may extend therethrough into locking engagement within a stem retention recess 57 formed in the bell stem 54. The stem retention recess 57 may extend partially or preferably completely through the bell stem, thereby permitting passage of a stem lock pin therethrough to prevent axial rotation of the compression bell 50 relative to the expansion segment 24. It is noted that the stem lock pin may include a threaded portion, as any stress placed on the stem lock pin will be in a sheering direction at a central portion of the stem lock pin and not on any threads included at a head portion of the stem lock pin.

Figure 3:
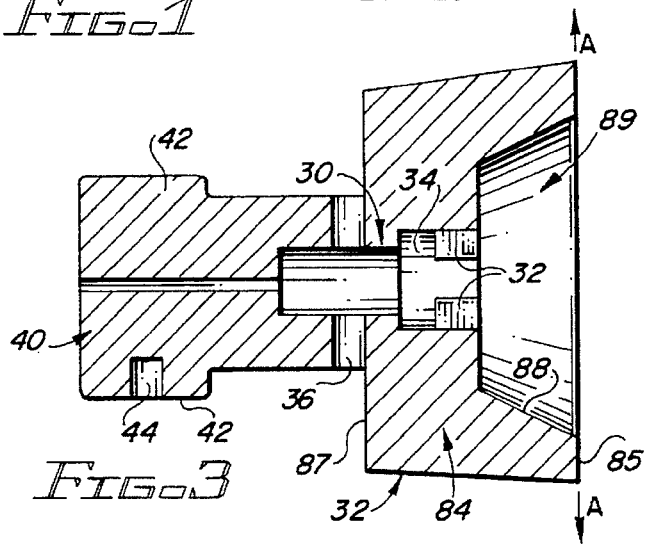
FIG. 3 is a side cross-sectional view of a preferred exterior dummy block member of the present invention.
Figure 4:
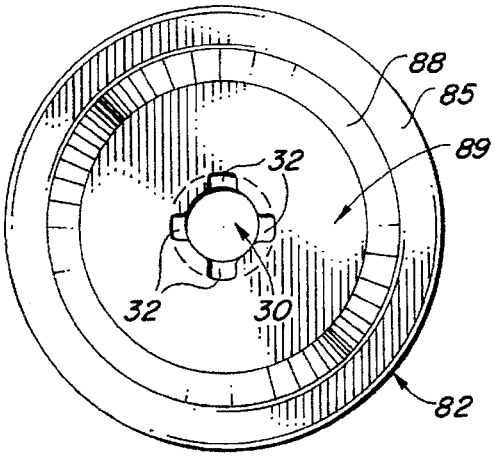
FIG. 4 is a front end view of the exterior dummy block member of the present invention.

Returning to the open interior area of the expansion segment 24, it is seen that the surrounding wall structure 53" of the bell head 52 is structured to matingly contact an interior surface 28 of the bell head containment portion 29 of the expansion segment 24. Further, the front face 53 of the bell head 52 is structured to protrude slightly from the open interior area of the expansion segment 24, and the rear face 53' of the bell head 52 is structured to be a spaced apart distance from the surface 28 of the bell head containment portion 29 of the expansion segment 24. Accordingly, as the fixed dummy block portion 30 is directed towards the metal billet by the extrusion press, the front face 53 of the bell 50 contacts the metal billet first. Under the great compressive force, the compression bell 50 is pushed into the expansion segment 24, thus reducing the spacing between the rear face of the bell head 52 and inner surface 28 of the bell head containment portion 29 of the expansion segment 24. This inward movement also results in an outward flexing or expansion of the expansion segment 24 as the surrounding wall surface 53 of the compression bell 50 pushes outwardly against the inner surface 28 of the expansion segment 24. This expansion of the expansion segment 24, as illustrated by arrows A in FIG. 3, increases an exterior diameter of the expansion segment 24 such that the expansion segment 24 only slightly spaced (preferably approximately forty thousandths of an inch) from the inner surface of the billet container 72. This minimization of the spacing between the expansion segment 24 and the billet container 72 prevents the outward seepage of metal billet and focuses all of the metal billet through the extrusion die while the pressure is being exerted by the extrusion press on the fixed dummy block assembly of the present invention. Also, so as to facilitate this expansion, a port 31 extends preferably through the connector segment 40 so as to permit the escape of air therethrough upon inward movement and compression of the compression bell 50 into the expansion segment 24.

Figure 1:
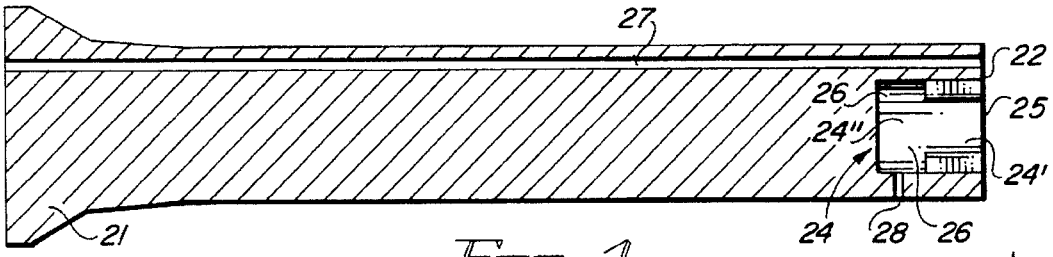
FIG. 1 is a side cross-sectional view of the stem of the improved fixed dummy block assembly of the present invention.
Figure 2:
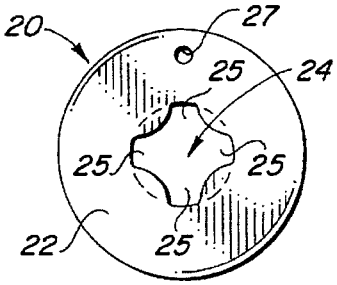
FIG. 2 is a first end view of the stem of the improved fixed dummy block assembly of the present invention.
Figure 5:
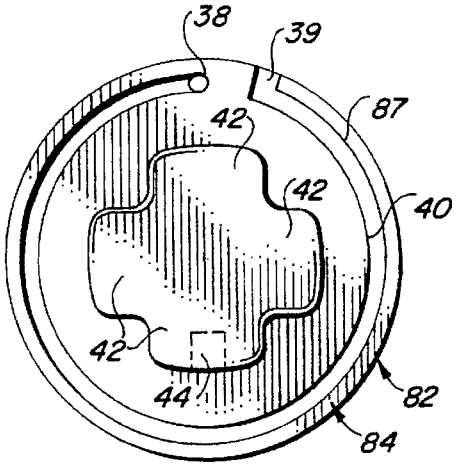
FIG. 5 is a rear end view of the exterior dummy block member of the present invention.
Figure 6:
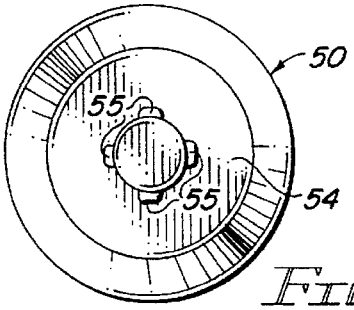
FIG. 6 is a rear plan view of the compression bell of the present invention.
Figure 7:
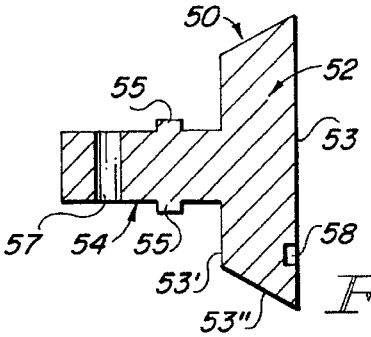
FIG. 7 is a side cross-sectional view of a preferred embodiment of the compression bell of the present invention.
Figure 8:
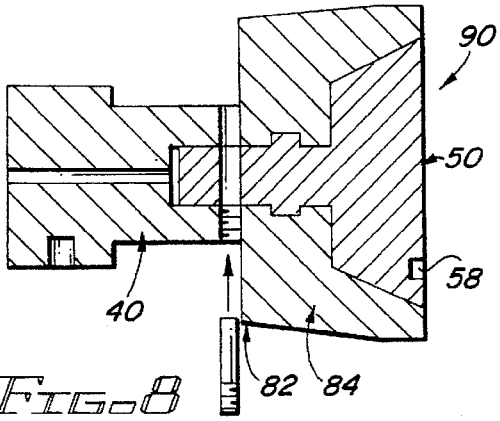
FIG. 8 is a cross-sectional view of the fixed dummy block portion of the improved fixed dummy block assembly of the present invention including the preferred exterior dummy block member and compression bell engaged with one another.

Turning to FIGS. 1 and 5, in the preferred embodiments of the present invention, the rear end 27 of the expansion segment 24 also includes a coolant channel 38 formed therein. This coolant channel 38, which can circle the rear end 27 of the expansion segment 24 a number of times or merely a single time as illustrated in the drawings, is structured and disposed to receive a coolant flow therethrough. The coolant flow is provided to maintain a temperature of the exterior dummy block member 22 substantially constant and prevent overheating or permanent deformation thereof. In this preferred embodiment, the stem 20 includes an axial channel 27 which runs the length of the stem 20, terminating in a flow outlet at the first end 22 of the stem 20. The flow outlet is in fluid flow communication with the coolant channel 38, and therefore preferably directs fluid through the stem 20, through the coolant channel 38 and preferably out an outlet 39, thereby ensuring that coolant effectively cycles therethrough.

Figure 11:
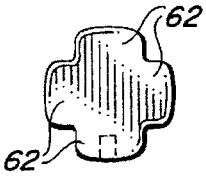
FIG. 11 is a rear end plan view of the axillary plug of the present invention.
Figure 12:
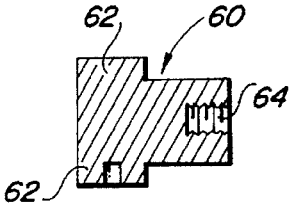
FIG. 12 is a side cross-sectional view of the axillary plug of the present invention.
Figure 10:
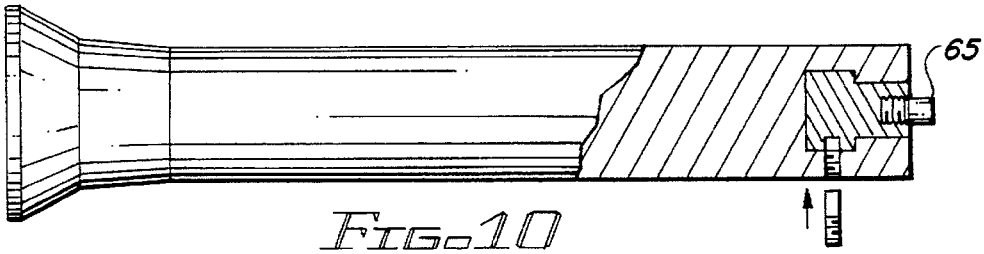
FIG. 10 is a side cross-sectional view of the stem of the present invention including the preferred axillary plug therein.

Finally, turning to FIGS. 10, 11 and 12, the preferred embodiment of the fixed dummy block assembly of the present invention also includes an auxiliary plug 60. This auxiliary plug 60 is structured to be securely, and lockingly disposed within the axial socket 24 formed in the stem. As such, the auxiliary plug 60 preferably includes a pair of auxiliary connector segments 62 which slide into an engaged position within the lock recesses 26 of the axial socket 24, and an auxiliary lock slot 63 into which the lock pin extends to retain the auxiliary plug 60 in its engaged orientation. This auxiliary plug 60 is structured with a threaded aperture 64 that receives a conventional dummy block plug 65, thereby enabling the fixed dummy block assembly of the present invention to be affectively utilized with a conventional dummy block. In particular, because of the affective interconnection between the compression bell 50 and the expansion segment 24, and the ability to make the overall length of the fixed dummy block portion 30 substantially short as compared with prior art fixed dummy blocks, the stem 20 is able to be maintained at a standard length that is useable with a standard dummy block. As a result, should any malfunction with the fixed dummy block portion 30 of the assembly of the present invention result, a user can quickly and easily remove the fixed dummy block portion 30 from the stem 20, can replace the auxiliary plug 60 into the axial socket 24 of the stem 20, and can be back and operational in a very brief period of time utilizing a conventional dummy block operation. Furthermore, when the fixed dummy block portion 30 is repaired or replaced it can be mounted on the stem immediately without having to first wait for the fixed dummy block portion to be preheated.

While this invention has been shown and described in what is considered to be a practical and preferred embodiment, it is recognized that departures may be made within the spirit and scope of this invention which should, therefore, not be limited except as set forth in the claims which follow and within the doctrine of equivalents.

Now that the invention has been described,

What is claimed is:

1. An improved fixed dummy block assembly to be used with a heavy duty metal extrusion assembly including a hydraulic press and a billet container having: (i) a die end over which an extrusion die is positioned and from which a formed part exits, (ii) an interior wall surface to contain a metal billet from which the formed part is extruded, and (iii) an open inlet end opposite the die end; said improved fixed dummy block assembly comprising:

a stem connected with the hydraulic press, said stem being disposed in axial alignment with a central axis of the billet container and being structured to be pushed towards said open inlet end of the billet container, said stem being generally elongate and including a first end disposed in confronting relation with said open inlet end of the billet container, an axial socket extending into said stem from said first end thereof and including an outer end at said first end of said stem and an inner end within an interior of said stem, an exterior dummy block member, said exterior dummy block member including an expansion segment and a connector segment, said connector segment being structured and disposed to be axially and slidingly inserted into said axial socket of said stem, said axial socket and said connector segment including lock means structured and disposed to secure said exterior dummy block member in axial alignment at said first end of said stem so as to prevent removal of said connector segment from said axial socket, said expansion segment of said exterior dummy block member including a front end, a rear end, and a surrounding wall structure defining an open interior area which extends inwardly from said front end, said open interior area including a bell head containment portion and a bell stem containment portion, a compression bell, said compression bell including a bell head, having a primary face, a rear face, and a surrounding wall structure, and a bell connector stem extending from said rear face of said bell head in a direction opposite said primary face of said bell head, said compression bell being structured and disposed to be contained within said open interior area of said expansion segment such that said bell stem extends into said bell stem containment portion of said open interior area of said expansion segment and said bell head is retained in said bell head containment portion of said open interior area of said expansion segment, said compression bell being structured and disposed to protrude from said front end of said expansion segment and to engage said expansion segment such that upon said primary face of said bell head engaging the metal billet within said billet container said compression bell will be pushed into said open interior area of said expansion segment resulting in an outward flexing of said surrounding wall structure of said expansion segment, said bell stem and said bell stem containment portion including bell locking means structured and disposed to maintain said bell stem securely, yet removably within said bell stem containment portion and thereby maintain said compression bell securely within said open interior area of said expansion segment, said bell locking means in said bell stem containment portion including at least one entry channel extending axially along an interior of said bell stem containment portion, and at least one lock recess formed in said interior of said bell stem containment portion in adjacent communication with said entry channel, said bell locking means on said bell stem further including at least one lock segment protruding from a perimeter of said bell stem, said lock segment being structured and disposed to slidingly move through said entry channel of said bell stem containment portion upon insertion of said bell stem of said compression bell into said bell stem containment portion in said expansion segment, and said lock segment being further structured and disposed to slide from said entry channel in said bell stem containment portion into an engaged position within said lock recess of said bell stem containment portion, upon axial rotation of said compression bell within said expansion segment, so as to prevent removal of said compression bell from said expansion segment unless said compression bell is affirmatively rotated out of said engaged position.

2. A fixed dummy block assembly as recited in claim 1 wherein said surrounding wall structure of said bell head is structured to matingly contact a surface of said bell head containment portion of said open interior area of said expansion segment and said rear face of said bell head is disposed a spaced apart distance from said surface of said bell head containment portion of said open interior area of said expansion segment so as to permit inward movement of said compression bell within said expansion segment.

3. A fixed dummy block assembly as recited in claim 2 further including a port extending through said connector segment so as to permit the expulsion of air upon said compression bell moving inwardly into said expansion segment.

4. A fixed dummy block assembly as recited in claim 1 wherein said bell locking means further include a bell lock slot extending from an exterior of said exterior dummy block member into said bell stem containment portion, and a stem lock pin extending through said stem lock slot into a stem retention recess extending at least partially into said bell stem so as to prevent axial rotation of said compression bell relative to said expansion segment out of said engaged position.

5. A fixed dummy block assembly as recited in claim 1 wherein said locking means on said axial socket includes at least one entry channel extending along an interior of said axial socket from said outer end of said axial socket generally to said inner end of said axial socket, and at least one lock recess formed in said interior of said axial socket generally at said inner end thereof in adjacent communication with said entry channel.

6. A fixed dummy block assembly as recited in claim 5 wherein said locking means on said connector segment includes at least one lock segment protruding from a perimeter of said connector segment, said lock segment being structured and disposed to slidingly move through said entry channel of said axial socket upon insertion of said connector segment of said exterior dummy block member into said axial socket in said stem, and said lock segment being further structured and disposed to slide from said entry channel in said axial socket into an engaged position within said lock recess of said axial socket, upon axial rotation of said connector segment within said axial socket, so as to prevent removal of said connector segment from said axial socket unless said connector segment is affirmatively rotated out of said engaged position.

7. A fixed dummy block assembly as recited in claim 6 wherein said locking means further include a lock slot extending from an exterior of said stem into said inner end of said axial socket in said stem, and a lock pin extending through said lock slot into a retention recess formed in said connector segment so as to prevent axial rotation of said connector segment relative to said axial socket out of said engaged position.

8. A fixed dummy block assembly as recited in claim 1 wherein said stem includes a standard length structured to operationally receive a standard dummy block therein.

9. A fixed dummy block assembly as recited in claim 8 further including an auxiliary plug structured to be securely, lockingly disposed within said axial socket of said stem upon removal of said exterior dummy block member therefrom, said auxiliary plug including a coupling end which protrudes from said stem and is structured and disposed to be lockingly secured with the standard block.

10. A fixed dummy block assembly as recited in claim 1 wherein said rear end of said expansion segment includes a coolant channel formed therein, said coolant channel being structured and disposed to receive a coolant flow therethrough, said coolant flow being structured and disposed to maintain a temperature of said exterior dummy block member substantially constant.

11. A fixed dummy block assembly as recited in claim 10 wherein said stem includes an axial channel terminating in a flow outlet at said first end thereof, said flow outlet being in fluid flow communication with said coolant channel in said rear end of said expansion segment.

12. An improved fixed dummy block assembly to be used with a heavy duty metal extrusion assembly including a hydraulic press and a billet container having: (i) a die end over which an extrusion die is positioned and from which a formed part exits, (ii) an interior wall surface to contain a metal billet from which the formed part is extruded, and (iii) an open inlet end opposite the die end; said improved fixed dummy block assembly comprising:

a stem connected with the hydraulic press, said stem being disposed in axial alignment with a central axis of the billet container and being structured to be pushed towards said open inlet end of the billet container, said stem being generally elongate and including a first end disposed in confronting relation with said open inlet end of the billet container, an axial socket extending into said stem from said first end thereof and including an outer end at said first end of said stem and an inner end within an interior of said stem, an exterior dummy block member, said exterior dummy block member including an expansion segment and a connector segment, said connector segment being structured and disposed to be axially and slidingly inserted into said axial socket of said stem, said axial socket and said connector segment including lock means structured and disposed to secure said exterior dummy block member in axial alignment at said first end of said stem so as to prevent removal of said connector segment from said axial socket, said expansion segment of said exterior dummy block member including a front end, a rear end, and a surrounding wall structure defining an open interior area which extends inwardly from said front end, said open interior area including a bell head containment portion and a bell stem containment portion, a compression bell, said compression bell including a bell head, having a primary face, a rear face, and a surrounding wall structure, and a bell connector stem extending from said rear face of said bell head in a direction opposite said primary face of said bell head, said compression bell being structured and disposed to be contained within said open interior area of said expansion segment such that said bell stem extends into said bell stem containment portion of said open interior area of said expansion segment and said bell head is retained in said bell head containment portion of said open interior area of said expansion segment, said compression bell being structured and disposed to protrude from said front end of said expansion segment and to engage said expansion segment such that upon said primary face of said bell head engaging the metal billet within said billet container said compression bell will be pushed into said open interior area of said expansion segment resulting in an outward flexing of said surrounding wall structure of said expansion segment, said bell stem and said bell stem containment portion including bell locking means structured and disposed to maintain said bell stem securely, yet removably within said bell stem containment portion and thereby maintain said compression bell securely within said open interior area of said expansion segment, said locking means on said axial socket includes at least one entry channel extending along an interior of said axial socket from said outer end of said axial socket generally to said inner end of said axial socket, at least one lock recess formed in said interior of said axial socket generally at said inner end thereof in adjacent communication with said entry channel, said locking means on said connector segment further including at least one lock segment protruding from a perimeter of said connector segment, said lock segment being structured and disposed to slidingly move through said entry channel of said axial socket upon insertion of said connector segment of said exterior dummy block member into said axial socket in said stem, and said lock segment being further structured and disposed to slide from said entry channel in said axial socket into an engaged position within said lock recess of said axial socket, upon axial rotation of said connector segment within said axial socket, so as to prevent removal of said connector segment from said axial socket unless said connector segment is affirmatively rotated out of said engaged position.

* * * * *